US010722058B1

(12) United States Patent
Wagner et al.

(10) Patent No.: US 10,722,058 B1
(45) Date of Patent: Jul. 28, 2020

(54) THERAPEUTIC PILLOW

(71) Applicant: Zelzeos LLC, Santa Fe, NM (US)

(72) Inventors: Robert James Wagner, Santa Fe, NM (US); Margie Elizabeth Wagner, Santa Fe, NM (US)

(73) Assignee: ZELZEOS LLC, Santa Fe, NM (US)

( * ) Notice: Subject to any disclaimer, the term of this patent is extended or adjusted under 35 U.S.C. 154(b) by 268 days.

(21) Appl. No.: 15/938,960

(22) Filed: Mar. 28, 2018

Related U.S. Application Data

(60) Provisional application No. 62/478,345, filed on Mar. 29, 2017.

(51) Int. Cl.
*A47G 9/10* (2006.01)
*A47G 9/00* (2006.01)

(52) U.S. Cl.
CPC ..... *A47G 9/109* (2013.01); *A47G 9/007* (2013.01); *A47G 2009/1018* (2013.01)

(58) Field of Classification Search
CPC ..... A47G 9/007; A47G 9/109; A47G 9/1081; A47G 2009/1018; A47G 9/10; A47C 7/38; A47C 7/383
USPC ..... D6/601
See application file for complete search history.

(56) References Cited

U.S. PATENT DOCUMENTS 2,700,799 A 9/1952 Tolkowsky
3,243,828 A 4/1966 McCarty
D273,071 S * 3/1984 Stark ..... A47G 9/109 D6/601
4,447,922 A * 5/1984 Brochu ..... A47D 1/103 297/391
4,850,067 A 7/1989 Latorre
5,016,303 A 5/1991 Tanaka
5,038,432 A 8/1991 Robillard et al.
5,088,141 A 2/1992 Meyer et al.
5,360,017 A 11/1994 Austin
5,363,524 A 11/1994 Lang
5,367,731 A 11/1994 O'Sullivan
5,471,691 A 12/1995 Ryndak
5,644,810 A 7/1997 Kato
5,661,862 A 9/1997 Ryndak
5,708,998 A 1/1998 Torbik
5,727,267 A 3/1998 Keilhauer
5,781,947 A 7/1998 Sramek
5,809,594 A 9/1998 Isogai
5,926,880 A 7/1999 Sramek
6,026,330 A 2/2000 Chuang
(Continued)

*Primary Examiner* — Eric J Kurilla
*Assistant Examiner* — James T Coble
(74) *Attorney, Agent, or Firm* — Polson Intellectual Property Law, PC; Christopher Sylvain

(57) ABSTRACT

A pillow device providing comfort, support, and correct spinal alignment when lying in either the supine position or on one's side. The pillow comprises a bottom pillow, a top pillow, and side supports. Each side support is attached to both the bottom pillow and top pillow. The bottom pillow is arranged between the side supports and the top pillow is mounted above the bottom pillow and the side supports. The bottom pillow and top pillow each have a cavity configured to receive a user's head and a neck portion configured to support a user's neck when lying in the supine position. The side supports and sides of the top pillow are configured to receive a user's head when lying on his or her side.

18 Claims, 5 Drawing Sheets

(56) References Cited

U.S. PATENT DOCUMENTS

| | | | | |
|---|---|---|---|---|
| 6,079,066 | A * | 6/2000 | Backlund | A47G 9/10 5/636 |
| 6,170,103 | B1 | 1/2001 | Wang et al. | |
| 6,226,818 | B1 | 5/2001 | Rudick | |
| 6,363,557 | B2 | 4/2002 | Chou | |
| 6,481,031 | B1 | 11/2002 | Hwang | |
| 6,671,906 | B1 | 1/2004 | Milligan | |
| 6,742,207 | B1 | 6/2004 | Brown | |
| 6,817,049 | B1 | 11/2004 | Hall | |
| 6,931,682 | B2 | 8/2005 | Kruger, Jr. | |
| 6,978,502 | B2 | 12/2005 | Calagui | |
| 6,981,288 | B1 | 1/2006 | Hu | |
| 6,993,800 | B2 | 2/2006 | Greenawalt et al. | |
| 7,032,264 | B2 | 4/2006 | Funatogawa | |
| 7,152,263 | B1 | 12/2006 | Delfs | |
| 7,788,750 | B2 | 9/2010 | Norstrem | |
| 7,856,687 | B2 | 12/2010 | Chou | |
| 7,886,382 | B2 | 2/2011 | Funatogawa | |
| 8,359,686 | B2 | 1/2013 | Hunter et al. | |
| 9,375,104 | B2 | 6/2016 | Abdo | |
| 2004/0006822 | A1 | 1/2004 | Milligan | |
| 2006/0123547 | A1 | 6/2006 | Ferber et al. | |
| 2008/0028528 | A1 | 2/2008 | Wilson | |
| 2008/0282474 | A1 | 11/2008 | Hsin | |
| 2009/0199341 | A1 | 8/2009 | Schantz | |
| 2009/0276960 | A1 | 11/2009 | Chou | |
| 2010/0125955 | A1 | 5/2010 | Mendez et al. | |
| 2010/0229307 | A1 | 9/2010 | Sato | |
| 2012/0023676 | A1 | 2/2012 | Hansen | |
| 2012/0079659 | A1 | 4/2012 | Loos | |
| 2013/0191996 | A1 | 8/2013 | Maliszewski | |
| 2013/0305457 | A1 | 11/2013 | Grunstein | |
| 2014/0020184 | A1* | 1/2014 | Loth | A47G 9/1081 5/640 |
| 2014/0026323 | A1* | 1/2014 | Bowers | A47G 9/10 5/636 |
| 2014/0101854 | A1 | 4/2014 | Watson | |
| 2015/0089743 | A1 | 4/2015 | Haworth et al. | |
| 2016/0338514 | A1* | 11/2016 | Chan | A47G 9/10 |
| 2017/0013977 | A1* | 1/2017 | Bard | A47G 9/10 |

* cited by examiner

THERAPEUTIC PILLOW

REFERENCE TO RELATED APPLICATIONS

This application claims the benefit of U.S. provisional patent application Ser. No. 62/478,345 filed Mar. 29, 2017, which is incorporated by reference herein for all purposes.

BACKGROUND

In general, sleeping in a supine position is beneficial for spinal alignment purposes while sleeping on one's side facilitates draining of fluid from the head, including chemical waste. However, conventional pillows typically do not provide sufficient neck support in the supine position or head support when lying on one's side. Therapeutic pillow devices are both known and numerous in the art. Certain devices are highly technical/mechanical and may even require calibration, and thus lose some of the comfort and ease of flexibility of traditional pillows. Some pillows may not provide adequate support or are not configured to sufficiently accommodate different sleeping positions (e.g., both the supine and side positions), and therefore do not produce the array of available therapeutic benefits. Other devices permit sideways rotation of the head when a user is lying supine, which may cause problems regarding neck soreness and/or stiffness. Further still, many devices are lacking in overall stability/integrity and are therefore subject to excessive shifting under pressure. Some devices aimed at providing adequate comfort and support produce other problems, such as heat retention and sweating with memory foams, or increased noise levels with beads, seeds, and shells. Of course, what is comfortable and has a sufficient level of support may vary from user to user depending on personal preferences. Likewise, even minor changes in design can have substantial effects on the overall "feel" of the pillow device.

The foregoing examples of the related art and limitations therewith are intended to be illustrative and not exclusive. Other limitations of the related art will become apparent to those of skill in the art upon a reading of the specification and a study of the drawings.

SUMMARY

The present disclosure relates to a therapeutic pillow device, specifically a device configured to allow lying on either one's side or back (supine). One aspect of the present disclosure is to provide and maintain adequate support, comfort, and alignment for both positions. Another aspect is to provide for at least partial structural bowing and cradling of a user. Another aspect is to prevent over-rotation of the head when lying supine. Another aspect is to reduce tossing and turning while sleeping and promote deeper, better sleep. Another aspect is to provide a durable device with a high degree of structural integrity and stability. Another aspect is to provide a pillow device that can accommodate individuals with a varying shoulder broadness without the need to adjust the device. A further aspect is to provide a pillow with good ventilation and heat dissipation properties.

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

A pillow device according to the present disclosure comprises a bottom pillow, a top pillow, and at least two side supports. The bottom pillow may be arranged in between the two side supports. The top pillow may be mounted above the side supports. Each side support may be attached to both the bottom pillow and the top pillow. An outer cover may be provided to encompass the bottom pillow, top pillow, and side supports. When a user lies in the supine position in the center of the pillow, the middle segments of the bottom and top pillows provide primary support to the user's head and neck, while the lateral segments of the bottom and top pillows provide secondary support to the sides of the user's head and neck, which also helps to retain the proper positioning of the user. The side supports may also wrap inward in this position, at least to some extent, thereby augmenting the lateral support of the user. When a user lies on her side over one of the side supports, the side support provides the primary support to the user's head and neck, in conjunction with the segment of the top pillow overlaying the side support.

The bottom pillow has at least a head cavity and a neck portion. The neck portion of the bottom pillow is positioned adjacent to the head cavity of the bottom pillow along the transverse axis. The top pillow has at least a head cavity and a neck portion. The neck portion of the top pillow is positioned adjacent to the head cavity of the top pillow along the transverse axis. The head cavities of the bottom and top pillows are configured to receive a user's head, and may be vertically aligned with each other. The neck portions of the bottom and top pillows are configured to support a user's neck, with the neck portion of the top pillow arranged above the neck portion of the bottom pillow in certain embodiments. An optional neck support insert may be provided in one, or both, of the neck portions to provide additional cervical support.

The neck portion of the bottom pillow may form the bottom pillow between the head cavity and a side of the bottom pillow over an angle, which extends radially outward from a central vertical axis of the head cavity of the bottom pillow. This angle may be symmetrically arranged about the transverse axis. In the same manner, the neck portion of the top pillow may form the top pillow between the head cavity and a side of the top pillow over another angle, which extends radially outward from a central vertical axis of the head cavity of the top pillow. This angle may also be symmetrically arranged about the transverse axis. These angles are adapted to receive a user's neck, which generally broadens in the transition from the head to the shoulders. Further, the angle defining the neck portion of the bottom pillow in the horizontal plane may be greater than the angle defining the neck portion of the top pillow. This aspect may further facilitate the bottom pillow's accommodation of the top pillow under the force of a user's weight.

The pillow may have a default structural arrangement where the bottom pillow is bowed upwards and the top pillow is bowed downwards. For example, when the pillow is not being used and therefore not under pressure from the user, the bottom surface of the neck portion of the bottom pillow may be arranged vertically higher than the bottom surfaces of the bottom pillow abutting the side supports. In this way, the neck portion of the bottom pillow may be elevated above the horizontal surface upon which the pillow device is placed when not subject to the downward force from a user's weight. Likewise, the top surface of the neck portion of the top pillow may be arranged vertically lower than the top surfaces of the top pillow positioned directly above the side supports. In some embodiments, the bottom pillow and the top pillow are joined together in at least one section adjacent to the head cavities. For example, the bottom and top pillows may be attached along the interior arcs of the neck portions forming a part of the head cavities. In certain embodiments, a second attachment between the bottom and top pillows may be provided opposite this first attachment with respect to the head cavities.

The top surface of each side support may have a depression shaped to receive the side of a user's head. For example, the depression may be offset a certain distance from the edge of the side support and slope into a shallow cavity. In this way, the neck of a user is supported at the perimeter of the top surface of the side support, while the depression is formed at the center of the top surface to receive the user's head, thereby promoting proper spinal alignment and comfort. In certain embodiments, each side support may comprise a cutout or opening facing the bottom pillow, while the bottom pillow further comprises a side portion extending laterally outward which is configured to fit into the cutout of the side support. The side support may be attached to the bottom pillow at least in a region of the side portion. This interlocking abutment may contribute to the structural integrity of the pillow device and transfer of forces therebetween.

Since the construction of the pillow device comprises separate components, a plurality of interstitial spaces may be formed between the bottom pillow and the top pillow. These interstitial spaces provide pockets of air which facilitate ventilation and heat dissipation, and increase the pillow's capacity to conform to different user body types. In some embodiments, at least one of the side supports may have a plurality of air channels extending horizontally or substantially horizontally through the side support. In this way, the air channels may be in fluid communication with the plurality of interstitial spaces, thereby augmenting ventilation and heat exchange across the side support between the interior of the pillow device and ambient air.

In addition to the aspects and embodiments described above, further aspects and embodiments will become apparent by reference to the accompanying drawings and the detailed description forming a part of this specification.

BRIEF DESCRIPTION OF THE DRAWINGS

The present disclosure is further described with reference to the following figures.

Before further explaining the depicted embodiments, it is to be understood that the invention is not limited in its application to the details of the particular arrangements shown, since the invention is capable of other embodiments. It is intended that the embodiments and figures disclosed herein are to be considered illustrative rather than limiting. Also, the terminology used herein is for the purposes of description and not limitation.

DETAILED DESCRIPTION

In describing positional relationships, the longitudinal axis runs horizontally through the central length of the device, the transverse axis runs horizontally through the central width of the device and is perpendicular to the longitudinal axis, and the vertical axis runs vertically through the central height of the device and is perpendicular to both the longitudinal and transverse axes. The definitions of the terms "attached," "connected," "joined" or similar language, and derivatives of such terms, include both direct and indirect attachments, connections, etc. For convenience, the term mattress is used to describe any horizontal surface upon which the pillow device is placed; it being appreciated that the device may of course be placed on any number of surfaces for use by a user—such as a couch, floor or the like.

Figure 1:
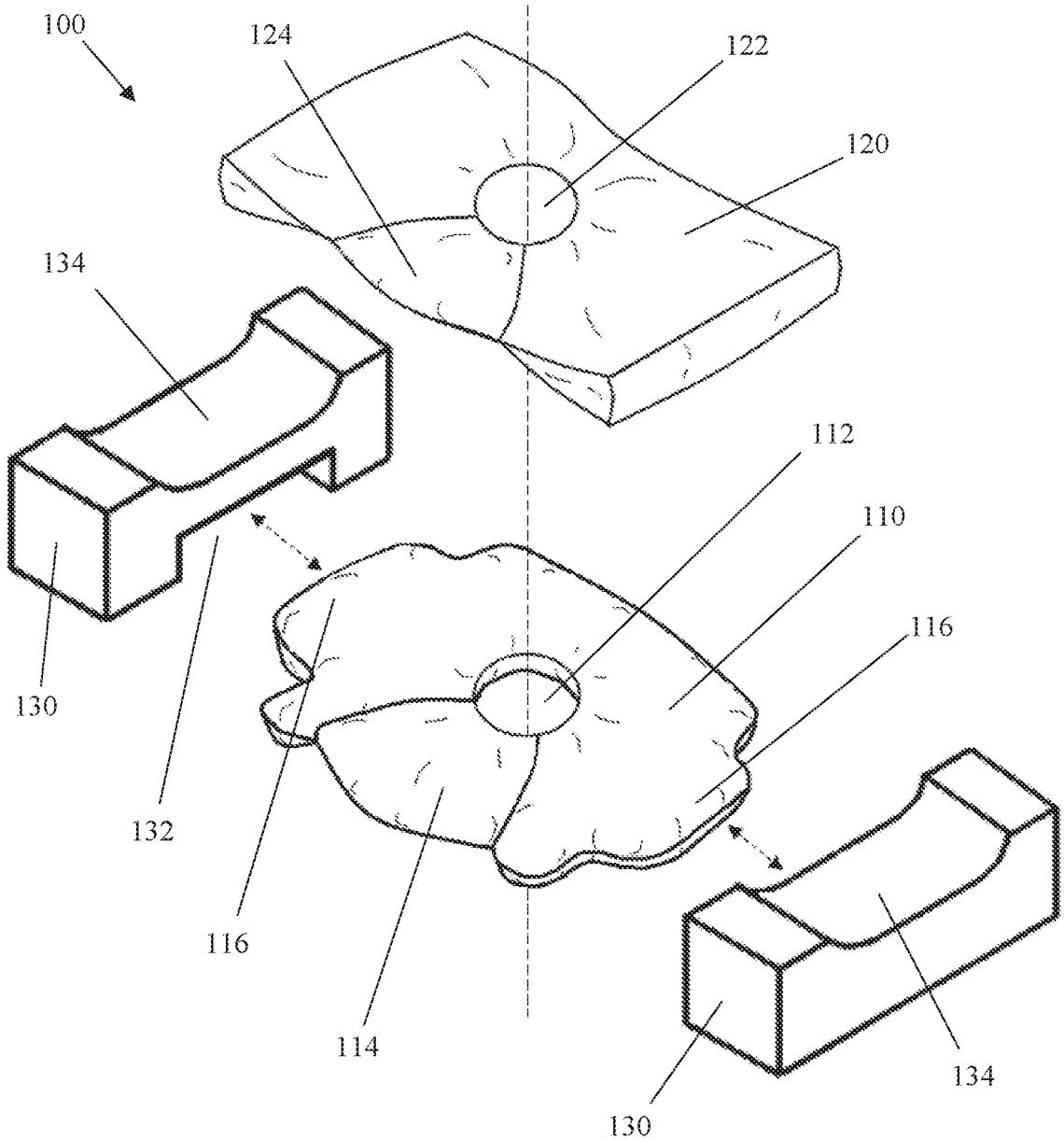
FIG. 1 shows an exploded perspective view of a pillow according to the present disclosure without an outer cover.

FIG. 1 shows an embodiment of a pillow device 100 according to the present disclosure. The pillow 100 comprises a bottom pillow 110, a top pillow 120, and two side supports 130. The bottom pillow 110 comprises at least a head cavity 112 and a neck portion 114. The bottom pillow 110 provides the base layer of support of the pillow 100. The bottom pillow 110 may also link each of the side supports 130 together. For example, in the depicted embodiment, the bottom pillow 110 further comprises two side portions 116 sized to fit into the cutouts 132 of the side supports 130.

The head cavity 112 is an aperture through approximately the center of the bottom pillow 110 configured to receive the head of a user. The head cavity 112 works in conjunction with the head cavity 122 of the top pillow 120 to support a user's head at a desired elevation above the mattress surface. In some embodiments, the head cavity 112 may further comprise some sort of covering (not shown), such as a solid piece of material, netting, screen, etc., which would similarly accommodate the insertion of the head into the cavity 112 to the proper positioning. This covering could be produced with enough excess material to provide slack or from a sufficiently elastic material (e.g., nylon, spandex).

The neck portion 114 of the bottom pillow 110 is configured to support the curvature of the neck of a user, in conjunction with the neck portion 124 of the top pillow 120. The neck portion 114 may form the part of the bottom pillow 110 located between the head cavity 112 and a side of the bottom pillow 110. The neck portion 114 may extend from an arc of the bottom pillow 110 (which partially forms the head cavity 112) outward to form a section of the longitudinal edge of the bottom pillow 110. In the horizontal plane, the arc may be generally defined by an angle—the vertex of the angle provided by the central vertical axis of the head cavity 112. Thus, the neck portion 114 forms the bottom pillow 110 over an angle extending radially outward from the vertical axis of the head cavity 112. For example, the angle may be between approximately 45° and 90° in some embodiments. In the depicted embodiment, the angle is approximately 70°. In this way, the neck portion 114 may expand to accommodate the widening of the neck as it transitions into the shoulders. The neck portion 114 may also be formed as a separate compartment from the remainder of the bottom pillow 110. In this way, the contents of the neck portion 110 are prevented from migrating out of the neck portion 114 toward the lateral ends of the main compartment of the bottom pillow 110 as may occur after repeated use (i.e. why conventional pillows are "fluffed"). As discussed below, the neck portion 114 may be slightly raised with respect to the mattress surface and the adjacent sections of the bottom pillow 110 proximate the side supports 130 (see FIG. 5).

The sections of the bottom pillow 110 adjacent to the head cavity 112 and the neck portion 114 provide additional support and lateral stabilization to a user's head and neck. When a user places her head in the center of the pillow 100, as in the supine position, the bottom pillow 110 at least partially depresses under the user's weight to wrap around the head and neck to provide additional support, comfort, and stabilization. The corresponding sections of the top pillow 120 adjacent to the head cavity 122 and the neck portion 124 can also bend in this way under pressure.

Figure 2:
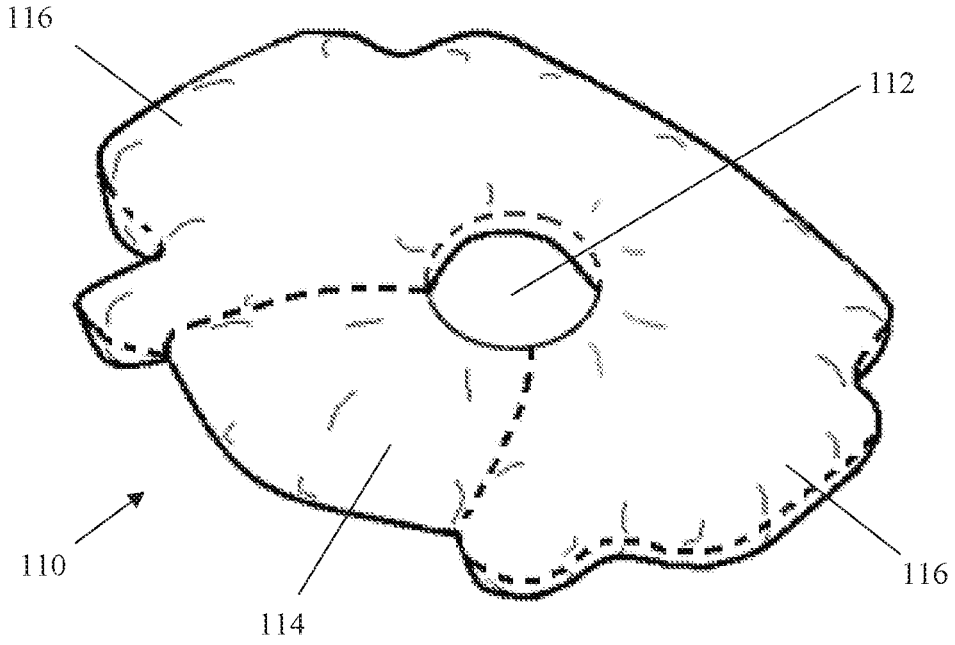
FIG. 2 shows the bottom pillow of FIG. 1 with seams represented in broken lines.

In the depicted embodiment, the bottom pillow 110 is formed by joinder of a top panel of material, a bottom panel of material, and an optional circular panel of material surrounding the head cavity 112 (see FIG. 2 showing seams joining the panels represented in broken lines). The neck portion 114 is formed by joining the top panel to the bottom panel with seams that extend from the front edge of the bottom pillow 110 through the interior edge of the bottom pillow 110 defining the perimeter of the head cavity 112. Of course, other panel configurations are possible within the spirit and scope of the present disclosure.

The top pillow 120 of the pillow device 100 comprises at least a head cavity 122 and a neck portion 124. The top pillow 120 provides the uppermost layer of support of the pillow 100. The top pillow 120 may also link each of the side supports 130 together. The top pillow 120 is mounted above the bottom pillow 110 and the side supports 130. The top pillow 120 may be sized to be largely coextensive with the horizontal footprint formed by the bottom pillow 110 and the side supports 130. In this way, the pillow 100 may have a generally box shaped appearance—sloping valleys from the bowing of the bottom and top pillows 110, 120 excepted—particularly if an outer cover 160 is used (see FIG. 9).

The head cavity 122 is an aperture through approximately the center of the top pillow 120 configured to receive the head of a user. The head cavity 122 works in conjunction with the head cavity 112 of the bottom pillow 110 to support a user's head at a desired elevation above the mattress surface. As described above with respect to the head cavity 112, the head cavity 122 may also include a covering in certain embodiments (not shown).

The neck portion 124 of the top pillow 120 is configured to support the curvature of the neck of a user, in conjunction with the neck portion 114 of the bottom pillow 110. The neck portion 124 may form the part of the top pillow 120 located between the head cavity 122 and a side of the top pillow 120. The neck portion 124 may extend from an arc of the top pillow 120 (which partially forms the head cavity 122) outward to form a section of the longitudinal edge of the top pillow 120. In the horizontal plane, the arc may be generally defined by an angle—the vertex of the angle provided by the central vertical axis of the head cavity 122. Therefore, the neck portion 124 forms the top pillow 120 over an angle extending radially outward from the vertical axis of the head cavity 122. For example, the angle may be between approximately 45° and 90° in some embodiments. In the depicted embodiment, the angle is approximately 60°. Thus, the neck portion 124 may expand to accommodate the widening of the neck as it transitions into the shoulders. The angle of the neck portion 114 may be larger than the angle of neck portion 124, as described in the depicted embodiment, for the purposes of dispersion as a user's weight is transferred from neck portion 124 to neck portion 114 and the bottom pillow 110 conforms to receive the top pillow 120. As with the neck portion 114, the neck portion 124 may be formed as a separate compartment from the remainder of the top pillow 120. In this way, the contents of the neck portion 124 are prevented from migrating out of the area of the neck portion 124 into the surrounding main compartment of the top pillow 120 as may occur after repeated use. As discussed below, the neck portion 124 may be positioned vertically lower than the adjacent sections of the top pillow 100 located above the side supports 130 (see FIG. 5).

The sections of the top pillow 120 adjacent to the head cavity 122 and the neck portion 124 provide additional support and lateral stabilization to a user's head and neck. When a user places her head in the center of the pillow 100, as in the supine position, the top pillow 120 at least partially depresses under the user's weight to wrap around the head and neck to provide additional support, comfort, and stabilization.

Figure 3:
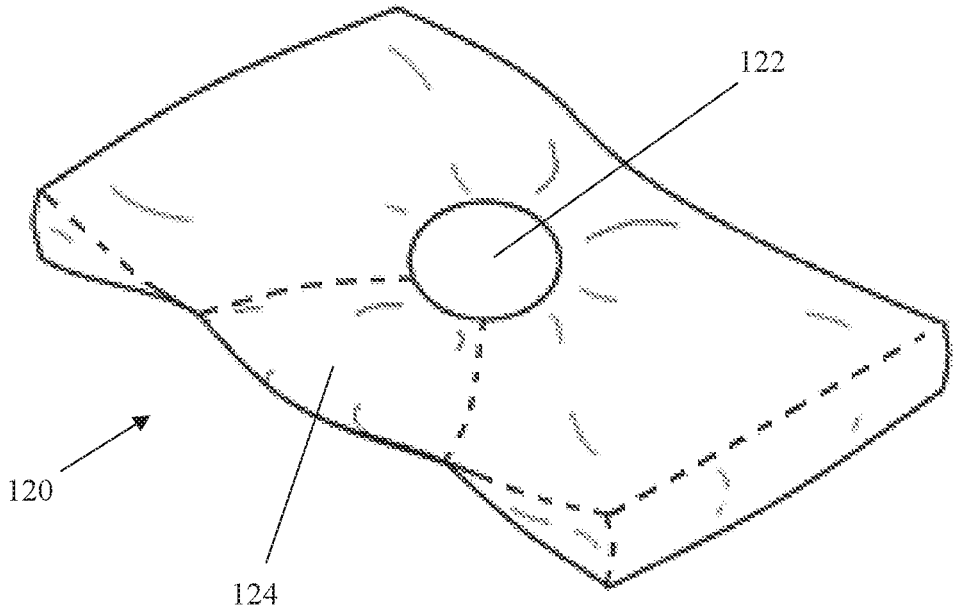
FIG. 3 shows the top pillow of FIG. 1 with seams represented in broken lines.

In the depicted embodiment, the top pillow 120 is formed by joinder of a top panel of material, a bottom panel of material, and side panels of material (see FIG. 3 showing seams joining the panels represented in broken lines). The neck portion 124 is formed by joining the top panel to the bottom panel with seams that extend from the front edge of the top pillow 120 through the interior edge of the top pillow 120 defining the perimeter of the head cavity 122. The generally triangular-shaped side panels of the top pillow 120 adjacent to the neck portion 124 may assist in accommodating the broadening transition of the neck into the shoulders. Of course, other panel configurations are possible within the spirit and scope of the present disclosure.

Figure 4:
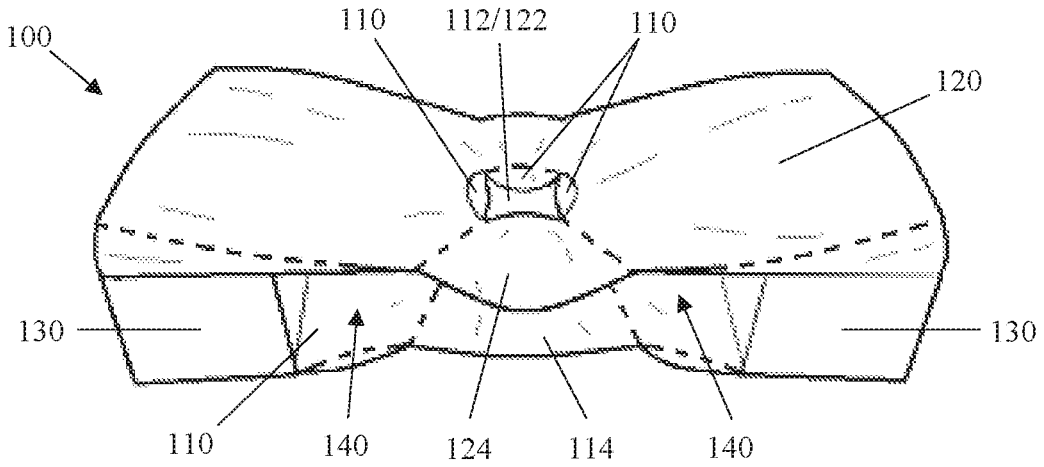
FIG. 4 shows an unexploded front perspective view of the pillow of FIG. 1.

As shown in FIG. 4, the bottom pillow 110 may be attached to the top pillow 120 in the region of the center of the pillow 100 comprising the head cavities 112, 122. For instance, the bottom and top pillows 110, 120 may be joined together in at least one section adjacent the first and second head cavities 112, 122. In the depicted embodiment, the neck portions 114, 124 are connected to each other proximate to the head cavities 112, 122 along the arcs of the bottom and top pillows 110, 120 forming the inner edges of the neck portions 114, 124, respectively. A second connection may also be provided between the bottom and top pillows 110, 120 on the other side of cavities 112, 122, which may be coextensive or substantially coextensive with the first connection. The positioning of these connections between the bottom and top pillows 110, 120 surrounding the head cavities 112, 122 may therefore be largely symmetrical about the transverse and longitudinal axes of the pillow 100 to one another. In some embodiments, the bottom and top pillows 110, 120 may be sewn together, although other attachments may also be used within the spirt and scope of the present disclosure.

Figure 5:
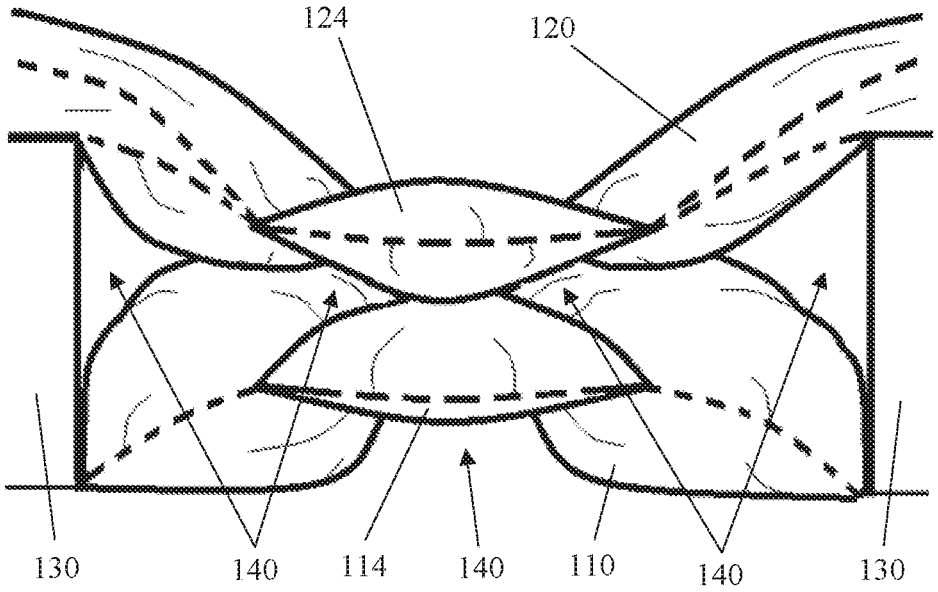
FIG. 5 shows a partial front view of the pillow of FIG. 4.

As shown in FIG. 5, the attachment of the bottom and top pillows 110, 120 to one another in the center of the pillow 100 causes the center of the bottom pillow 110 to bow upward relative to adjacent sections of the bottom pillow 110 along the longitudinal axis. In this way, the neck portion 114 is positioned higher relative to the vertical axis than the lateral sections of the bottom pillow 110 abutting the side supports 130, at least in reference to the bottom surfaces of these components. Likewise, the bowing of the bottom pillow 110 causes the neck portion 114 to be elevated from the mattress when the pillow 100 is not in use. The attachment of the bottom and top pillows 110, 120 to one another in the center of the pillow 100 causes the center of the top pillow 120 to bow downward relative to adjacent sections of the top pillow 120 along the longitudinal axis. In this way, the neck portion 124 is positioned lower relative to the vertical axis than the lateral sections of the top pillow 120 arranged above the side supports 130, at least in reference to the top surfaces of these components.

Accordingly, the head cavities 112, 122 and neck portions 114, 124 support the head and neck in an advantageous position when a user is lying supine thereon, while sections of the bottom and top pillows 110, 120 adjacent to the cavities 112, 122 and portions 114, 124 cradle a user's head to prevent left or right swaying and therefore retain positioning. Therefore, the pillow 100 may be configured to allow rotation of the head between approximately 45° left or 45° right to accommodate ordinary movement during sleep (such that the user does not feel restrained), but otherwise provide the side support necessary to prevent over-rotation of the head and resulting neck soreness/stiffness.

As best seen in FIGS. 4 and 5, the pillow 100 may comprise a plurality of interstitial spaces 140 formed by the structural arrangement of the bottom and top pillows 110, 120 between the side supports 130. These interstitial spaces 140 provide pockets of air for ventilation and heat dissipation, as well as allow the pillow 100 to adapt to and accommodate different body types when the downward force of a user's weight is applied to the pillow 100. In this way, the interstitial spaces 140 may further augment physical comfort and cooling properties of the pillow structure.

Figure 6:
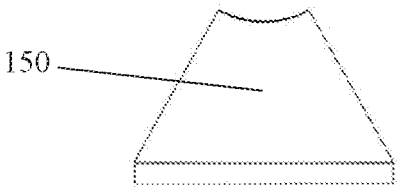
FIG. 6 shows a front perspective view of an optional neck support insert.

In FIG. 6, an optional neck support insert 150 is shown. The neck support insert 150 may be provided in one, both, or neither of the neck portions 114, 124. The neck support insert 150 has a generally triangular shape truncated to accommodate the curvature of the head cavities. The neck support insert 150 may provide additional support to a user's neck if desired, although the filling of the neck portions 114, 124 may also be adjusted to provide such support without inclusion of the neck support insert 150. Like the side supports 120, the optional neck support insert 150 may be made of foam, such as an organic latex foam, but any other suitable materials with similar characteristics of support and comfort may also be used. It should be appreciated that similar inserts (not shown) of varying shapes may optionally be provided to provide additional support in other positions of the bottom pillow 110 and/or the top pillow 120, if desired, and still fall within the scope and spirit of the present disclosure. Further, the neck support insert 150, or any other support insert, may also comprise air channels as described in more detail below in reference to FIG. 8.

Figure 7:
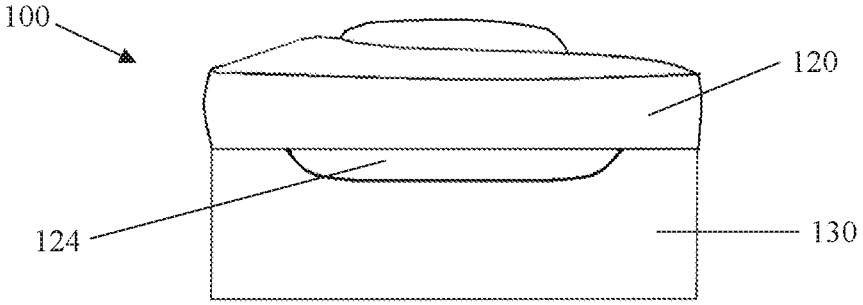
FIG. 7 shows a side perspective view of the pillow of FIG. 4.

Referring again to FIG. 1, the side supports 130 of the pillow 100 provide the primary support for a user's head when lying on either side. In some embodiments, the side supports 130 are made of foam, such as an organic latex foam, but any other suitable materials with similar characteristics of support and comfort may also be used. In the depicted embodiment, the side supports 130 each have a cutout 132 shaped to complimentarily receive one of the side portions 116 of the bottom pillow 110. Each side support 130 may also have a depression 134 configured to receive the head of a user when laying on his or her side, in conjunction with a lateral section of the top pillow 120 arranged above the depression 134 (see FIG. 7). The depressions 134 are generally U-shaped in the depicted embodiment, but may also comprise other forms as well (e.g., bowl-shaped).

The side supports 130 may have covers (not shown) to provide for attachment with the bottom pillow 110 and/or top pillow 120. These covers may further contribute to the structural integrity and overall cushioning effect of the side supports 130. In some embodiments, the side supports 130 may be encompassed by full covers, such as fabric cases. In other embodiments, each side support 130 may have two endcap covers which slip over the ends of the support 130 on either side of the side support cavities 132, 134. For purposes of attachment, the side supports 130 may be attached, either directly or indirectly, to the bottom pillow 110 in one or more regions of the side portions 116 and/or regions adjacent to the side portions 116 (i.e. sections of the bottom pillow 110 abutting the side supports 130 but not positioned within the side portion cutouts 132). In the same way, the side supports 130 may be attached to the top pillow 120 in one or more overlaying regions. For example, peripheral edges of the bottom pillow 110 and/or top pillow 120 abutting the side supports 130 may be sewn to the side support covers in certain embodiments. Of course, other attachments besides sewing are possible within the scope and spirit of the present disclosure. The relative positioning of the components 110, 130, 120 may also be indirectly secured via an outer covering, as discussed below.

By attaching the side supports 130 to the bottom pillow 110 and/or top pillow 120, the structural integrity of the pillow 100 is augmented and therefore the pillow 100 may better absorb stresses from user movement, including restless sleepers, with reduced deformation and wear over time. The positioning of the side portions 116 of the bottom pillow 110 within the cutouts 132 of the side supports 130 also provides additional support to a user lying on her side. Further, when a user lies supine in the center of the pillow 100, the downward forces may be distributed through the bottom pillow 110 underneath the side supports 130 and/or the top pillow 120 above the side supports 130. In this way, the side supports 130 may be pushed and/or pulled upward and inward, thereby contributing to the wrapping effect when a user's weight is applied to the center of the pillow 100. This cradling helps prevent the user's head from falling too far to either side when lying supine, which is known to produce neck stiffness and/or soreness. This three-piece construction, with the relative positions of the components 110, 130, 120 secured, also reduces the tendency of the pillow filling and foam supports to amorphously flatten out under pressure.

Figure 8:
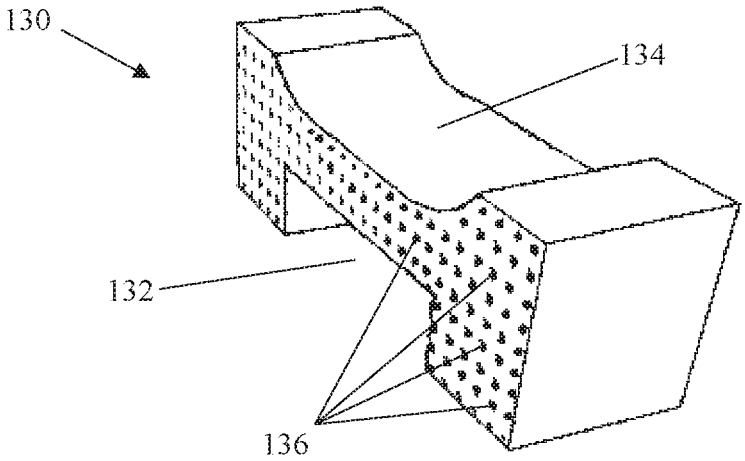
FIG. 8 shows a perspective view of another embodiment for the side support.

As seen in FIG. 8, certain embodiments of the side supports 130 may further comprise a plurality of air channels 136 extending therethrough. The air channels 136 may facilitate heat dissipation and ventilation between the pillow device 100 and surrounding air. For example, in the depicted embodiment, the air channels 136 extend horizontally or substantially horizontally through the side support 130. These air channels 136 are then, at least to some extent, in fluid communication with the interstitial spaces 140 formed by the bottom and top pillows 110, 120 described above. Thus, relatively more heat and airflow exchange are possible between the interior of the pillow 100 and ambient air. In this way, the heat retention and cooling properties of the pillow 100 may be further augmented, thereby contributing to overall user comfort. It should also be appreciated that other components and inserts may have air channels as well, and that the orientation of such air channels may be selected according to the structure of component/insert and the positioning thereof within the pillow device 100. For example, the neck support insert 150 may further comprise a plurality of air channels (not shown) extending vertically or substantially vertically therethrough. In such embodiments, the air channels may heat dissipation and ventilation between a user (above) and the interior of the pillow 100 (below) without compromising stability and the structural integrity of the neck support insert 150.

Figure 9:
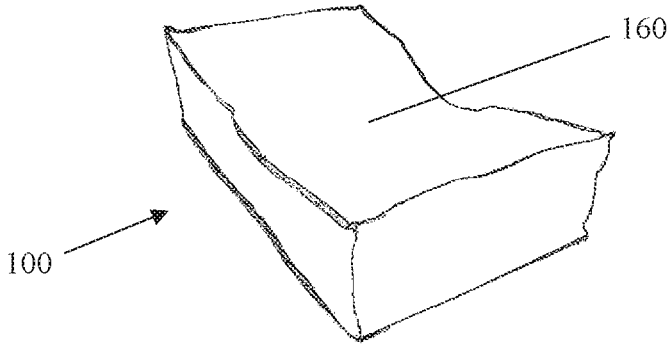
FIG. 9 shows a perspective view of the pillow of FIG. 4 with an outer cover.

As seen in FIG. 9, the pillow 100 may be enclosed by an outer cover 160 for aesthetics, comfort and the cohesiveness of the components therein. In some embodiments, the outer cover 160 may comprise a generally hourglass shape when the pillow 100 is viewed from the front side to conform with the upward bowing of the bottom pillow 110 and the downward bowing of the top pillow 120, as described above. Furthermore, in certain embodiments, one or more structural attachments between the bottom pillow 110, the top pillow 120, and the side supports 130 may be functionally replaced if the outer cover 160 encompassing these components is sufficiently taut. In yet other embodiments (not shown), a heating pad may be provided in the pillow 100; for example, the outer cover 160 may have a pocket or sleeve for a heating pad positioned along a longitudinal side of the pillow device to provide thermal relief to the neck and shoulders of users.

In some embodiments (not shown), the bottom pillow 110 and/or the top pillow 120 may have an additional neck portion arranged symmetrically opposite the other neck portion 114, 124, respectively, about the longitudinal axis. These additional neck portions may be provided with different amounts or types filling compared to the other neck portion 114, 124, or even be left unfilled. Such variance offers the ability to provide relatively firmer and softer neck support options for users. The necks portions could also be provided with the same firmness, such that each side of the pillow is identical, particularly if the user prefers a specific amount of support. Accordingly, the user can simply rotate the pillow device by 180° in the horizontal plane to go between configurations, and vice versa. The ability to utilize more than one orientation of the pillow also increases the expected lifetime utility of the device, since the sides being slept on may be readily alternated if ordinary wear and continuous use begins to decrease the comfort of any particular side.

The compartments of both the bottom pillow 110 and the top pillow 120 may be stuffed with a filling comprising shredded foam, buckwheat, or a combination thereof. The foam provides support and noise reduction to the composition, compared to straight buckwheat pillows which may be noisy and shift under pressure (like a bean bag). The composition may be hypoallergenic in some embodiments. Of course, different ratios as well as additional and/or substitute materials may also be used to achieve a desired feel, and still fall within the spirit and scope of the present disclosure. The shredded foam may be produced from the same foam that is used in the side supports 130, such as organic latex foam, for example.

The following details an embodiment of a pillow device described herein that is sized to accommodate an average adult person. However, the device may also be proportionally oversized or undersized (e.g., for children). The illustrative dimensions are provided with respect to this embodiment only, and may be adjusted to account for ordinary design modifications. Strict construction as to the disclosed parameters is neither intended nor should such limitation be inferred; variation therefrom is within the scope and spirit of the present disclosure. Accordingly, the bottom pillow may comprise a length of approximately 17 inches (43.2 cm) along the longitudinal axis, a width of approximately 13 inches (33 cm) along the transverse axis, and a height of approximately 4 inches (10 cm) along the vertical axis at its highest point. The top pillow may comprise a length of approximately 24 inches (61 cm) along the longitudinal axis, a width of approximately 13 inches (33 cm) along the transverse axis, and a height of approximately 2¾ inches (7 cm) along the vertical axis at its highest point. The head cavities of both the top and bottom pillows may each comprise a diameter of approximately 4 inches (10 cm). When the pillow device is not in use, the bottom surface of the neck portion of the bottom pillow may be elevated about 3 cm above the mattress, the top surface of the neck portion of the bottom pillow may abut the bottom surface of the neck portion of the top pillow about 8 cm above the mattress, and the top surface of the neck portion of the top pillow may be elevated about 12 cm above the mattress. The side supports may comprise a length of approximately 13 inches (33 cm) along the transverse axis, a width of approximately 4½ inches (11 cm) along the longitudinal axis, and a height of approximately 4½ inches (11 cm) along the vertical axis. The depressions for a user's head on the top surface of the side supports may have a length of approximately 9¼ inches (23.5 cm) arranged symmetrically about the longitudinal axis of the pillow device, the depressions having a slope which transitions to a maximum depth of approximately 1 inch (2.5 cm) relative to the top surface of the side supports. Due to the bowing of the bottom and top pillows, the absolute length of the pillow device may be about 22 inches (56 cm). It should be appreciated that if the size of the bottom and top pillows is continually increased along the longitudinal axis, at some point the downward force of the user's weight will not cause an uplift effect on the side supports, which otherwise wrap inward and further cradle the head of the user in the supine position at least to some extent.

Figure 10:
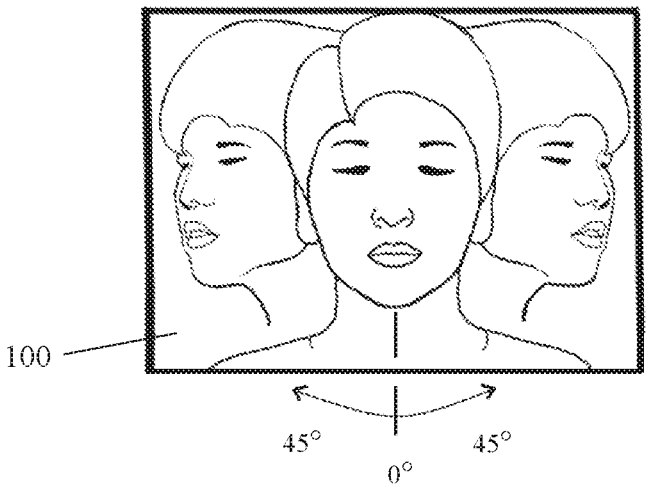
FIG. 10 shows a user lying supine in the center of a pillow according to the present disclosure from above through a supported range of motion.
Figure 11:
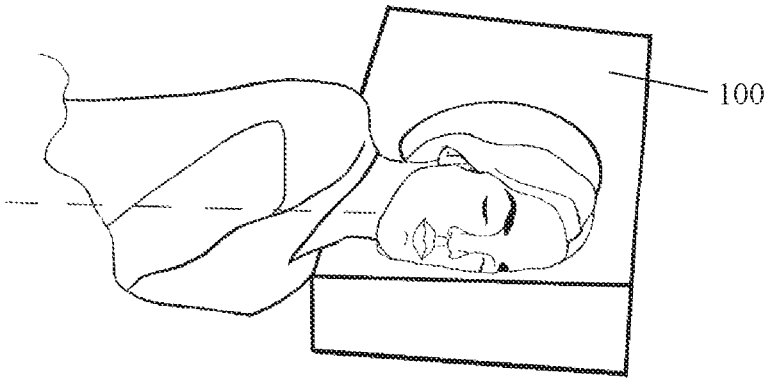
FIG. 11 shows a user lying on her side on the side support of a pillow device according to the present disclosure.
Figure 12:
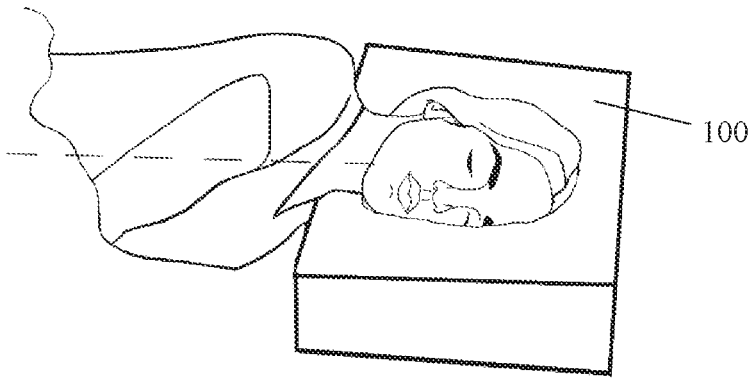
FIG. 12 shows a user lying on her side in the center of a pillow device according to the present disclosure.

With the foregoing in mind, FIGS. 10-12 show a user using the pillow device 100 in various positions according to the present disclosure. FIG. 10 shows a user lying in the supine position on the pillow 100. Here, the back of the user's head is aligned with and positioned within the head cavities 112, 122 while the back of the user's neck is supported by the neck portions 114, 124 of the bottom pillow 110 and the top pillow 120, respectively. The bottom pillow 110 and the top pillow 120 are configured to bow, at least partially, under the weight of the user, thereby further supporting the lateral sides of the user's head and neck and causing the side supports 130 to cradle inward for the same. In this way, the pillow 100 may allow the user's head to sway approximately 45° left or right to accommodate ordinary movement during sleep (such that the user does not feel restrained), but otherwise provides sufficient side support to prevent over-rotation of the user's head (which may result neck soreness/stiffness). Therefore, the pillow 100 provides proper spinal alignment via positioning of the head and neck, as well as helps to retain this positioning by laterally supporting the head and neck without covering the face or ears (which may result in discomfort).

FIG. 11 shows a user lying on her left side using the pillow 100. The user's head is primarily supported by one of the side supports 130 and the top pillow 120. As discussed above, the side support 130 may have a depression 134 configured to receive and cradle the side of the user's head, which provides additional comfort and helps retain proper positioning to some degree. Therefore, the head is sufficiently supported to facilitate fluid draining therefrom and to comfortably maintain spinal alignment. Since the pillow 100 is symmetrical about the transverse axis, the above description applies equally to when the user is lying on her right side.

FIG. 12 shows a user lying on her left side in the center of the pillow 100, rather than to one the sides. For users with smaller shoulders, the side supports 130 may provide too much elevation for these users' preference and benefit. Therefore, the center of the pillow 100 may also be used to accommodate lying on one's side. In this case, the side of the user's head is positioned within the head cavities 112, 122 of the bottom pillow 110 and the top pillow 120, respectively. The user's neck is supported by the neck portions 114, 124, while the remainder of the bottom and top pillows 110, 120 support the user's head. Accordingly, proper spinal alignment and fluid draining may be realized even where the user's shoulders are not broad enough to comfortably use the side supports 130.

While a number of aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations, which are within their true spirit and scope. Each embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by exemplary embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure. When a Markush group or other grouping is used herein, all individual members of the group and all combinations and sub-combinations possible of the group are intended to be individually included in the disclosure.

In general, the terms and phrases used herein have their art-recognized meaning, which can be found by reference to standard texts, journal references and contexts known to those skilled in the art. The above definitions are provided to clarify their specific use in the context of the invention.

The invention claimed is:

1. A pillow device comprising:

a bottom pillow, a top pillow, and two side supports;

the bottom pillow having at least a first head cavity and a first neck portion adjacent to the first head cavity along a transverse axis of the bottom pillow;

the top pillow having at least a second head cavity and a second neck portion adjacent to the second head cavity along a transverse axis of the top pillow;

the first head cavity and the second head cavity are configured to receive a user's head;

the first neck portion and the second neck portion are configured to support a user's neck;

the bottom pillow is arranged in between the sides supports, wherein the bottom pillow comprises at least one side portion extending laterally outward, and at least one of the side supports has a cutout shaped to receive the side portion of the bottom pillow;

the top pillow is arranged above the bottom pillow and each of the side supports;

each of the side supports is attached to the bottom pillow and the top pillow;

the second head cavity is vertically aligned with the first head cavity;

the second neck portion is positioned above the first neck portion; and the bottom pillow is bowed upwards and the top pillow is bowed downwards.

2. The pillow device of claim 1, wherein, when the pillow device is not in use, a bottom surface of the first neck portion is vertically higher than bottom surfaces of the bottom pillow abutting the side supports.

3. The pillow device of claim 1, wherein a top surface of the second neck portion is vertically lower than top surfaces of the top pillow positioned above the side supports.

4. The pillow device of claim 1, wherein the bottom pillow and the top pillow are joined together in at least one section adjacent the first head cavity and the second head cavity.

5. The pillow device of claim 1, wherein the first neck portion forms the bottom pillow over a first angle extending radially outward from a central vertical axis of the first head cavity, the second neck portion forms the top pillow over a second angle extending radially outward from a central vertical axis of the second head cavity, and the first angle is greater than the second angle.

6. The pillow device of claim 1, further comprising a plurality of interstitial spaces formed between the bottom pillow and the top pillow.

7. The pillow device of claim 1, wherein each of the side supports further comprises a depression shaped to receive a user's head.

8. The pillow device of claim 1, wherein at least one side support comprises a plurality of air channels extending horizontally or substantially horizontally through the side support.

9. A pillow device comprising:

a bottom pillow, a top pillow, and two side supports;

the bottom pillow having at least a first head cavity and a first neck portion adjacent to the first head cavity along a transverse axis of the bottom pillow;

the top pillow having at least a second head cavity and a second neck portion adjacent to the second head cavity along a transverse axis of the top pillow;

the first head cavity and the second head cavity are configured to receive a user's head;

the first neck portion and the second neck portion are configured to support a user's neck;

the bottom pillow is arranged in between the sides supports, wherein the bottom pillow comprises at least one side portion extending laterally outward, and at least one of the side supports has a cutout shaped to receive the side portion of the bottom pillow;

the top pillow is arranged above the bottom pillow and each of the side supports;

each of the side supports is attached to the bottom pillow and the top pillow;

the second head cavity is vertically aligned with the first head cavity;

the second neck portion is positioned above the first neck portion;

the first neck portion forms the bottom pillow between the first head cavity and a side of the bottom pillow over a first angle, the first angle extending radially outward from a central vertical axis of the first head cavity and symmetrically arranged about the transverse axis of the bottom pillow; and the second neck portion forms the top pillow between the second head cavity and a side of the top pillow over a second angle, the second angle extending radially outward from a central vertical axis of the second head cavity and symmetrically arranged about the transverse axis of the top pillow.

10. The pillow device of claim 9, wherein the first angle is greater than the second angle.

11. The pillow device of claim 10, wherein the first angle is approximately 70° and the second angle is approximately 60°.

12. The pillow device of claim 9, wherein the bottom pillow is bowed upwards and the top pillow is bowed downwards.

13. The pillow device of claim 9, wherein the bottom pillow and the top pillow are joined together in at least one section adjacent the first head cavity and the second head cavity.

14. The pillow device of claim 9, further comprising a plurality of interstitial spaces formed between the bottom pillow and the top pillow.

15. The pillow device of claim 9, wherein each of the side supports further comprises a depression shaped to receive a user's head.

16. The pillow device of claim 9, wherein at least one side support comprises a plurality of air channels extending horizontally or substantially horizontally through the side support.

17. A pillow device comprising:

a bottom pillow, a top pillow, two side supports, and a plurality of interstitial spaces formed between the bottom pillow and the top pillow;

the bottom pillow having at least a first head cavity and a first neck portion adjacent to the first head cavity along a transverse axis of the bottom pillow;

the top pillow having at least a second head cavity and a second neck portion adjacent to the second head cavity along a transverse axis of the top pillow;

the first head cavity and the second head cavity are configured to receive a user's head;

the first neck portion and the second neck portion are configured to support a user's neck;

the bottom pillow is arranged in between the sides supports, wherein the bottom pillow comprises at least one side portion extending laterally outward, and at least one of the side supports has a cutout shaped to receive the side portion of the bottom pillow;

the top pillow is arranged above the bottom pillow and each of the side supports;

each of the side supports is attached to the bottom pillow and the top pillow;

the second head cavity is vertically aligned with the first head cavity;

the second neck portion is positioned above the first neck portion;

the bottom pillow is bowed upwards and the top pillow is bowed downwards;

the first neck portion forms the bottom pillow over a first angle extending radially outward from a central vertical axis of the first head cavity;

the second neck portion forms the top pillow over a second angle extending radially outward from a central vertical axis of the second head cavity;

wherein the first angle is greater than the second angle.

18. The pillow device of claim 17, wherein the bottom pillow and the top pillow are joined together in at least one section adjacent the first head cavity and the second head cavity.

* * * * *